United States Patent [19]

Voges

[11] 4,114,796

[45] Sep. 19, 1978

[54] CONTAINER HAVING BRACED PARTITIONS

[75] Inventor: Fred Paul Voges, Park Ridge, Ill.

[73] Assignee: Consolidated Packaging, Inc., Chicago, Ill.

[21] Appl. No.: 735,259

[22] Filed: Oct. 26, 1976

[51] Int. Cl.[2] ..... B65D 5/48; B65D 5/02

[52] U.S. Cl. ..... 229/27; 229/37 R

[58] Field of Search ..... 229/27, 37 R, 28

[56] References Cited

U.S. PATENT DOCUMENTS

| | | | |
|---|---|---|---|
| 2,913,101 | 11/1959 | Daily | 229/27 X |
| 3,233,726 | 2/1966 | Gero | 229/27 X |
| 3,313,466 | 4/1967 | Keith | 229/27 |
| 3,326,444 | 6/1967 | Farquhar et al. | 229/27 |
| 3,403,836 | 10/1968 | Farquhar | 229/27 |
| 3,446,414 | 5/1969 | Omori | 229/28 |
| 3,542,259 | 11/1970 | Marchesani | 229/37 R X |
| 3,952,941 | 4/1976 | Zimmerman | 229/27 X |

*Primary Examiner*—Davis T. Moorhead

*Attorney, Agent, or Firm*—Hill, Gross, Simpson, Van Santen, Steadman, Chiara & Simpson

[57] ABSTRACT

A sheet-form blank is die-scored and -cut to form side walls, end flaps and pairs of inwardly-foldable partition bands. The bands are severed horizontally from the side walls and left attached by end folds to the side walls. Each of the partition bands in each pair has an attachment zone on a face thereof to engage a similar attachment zone on the other. One spot of glue between each pair of partition bands on the attachment zones thereof attaches the pair together in both collapsed and erected positions thereof. Two to 36 or more partitioned cells in any arrangement provided in each container are automatically formed upon erecting the outer walls into rectangular configuration.

8 Claims, 11 Drawing Figures

Fig. 1
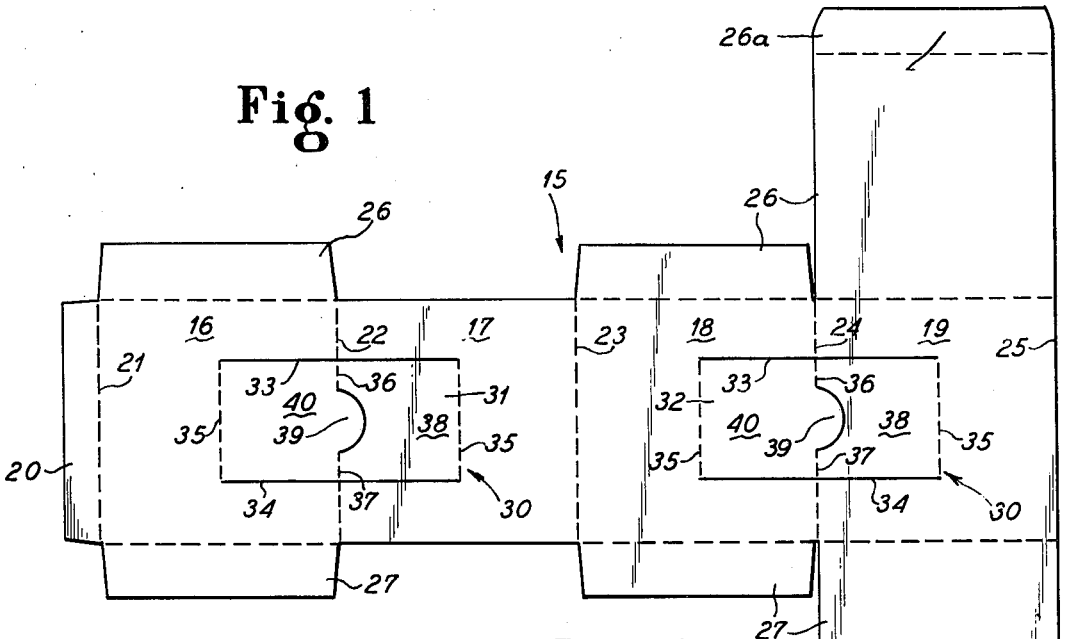
Fig. 2
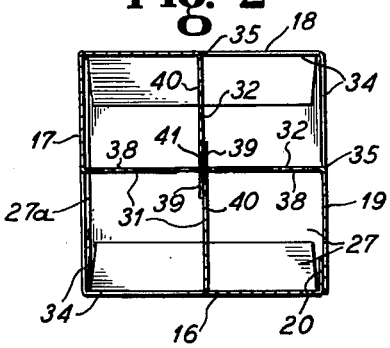
Fig. 4
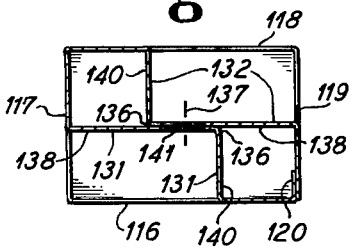
Fig. 3
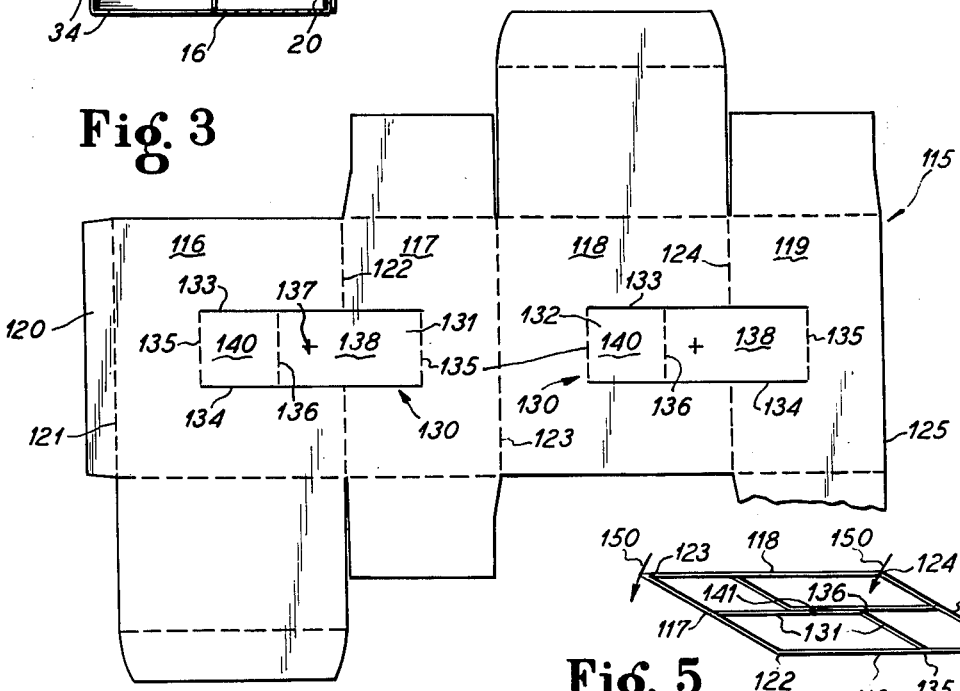
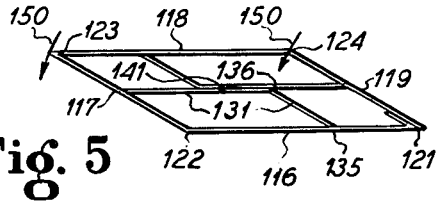
Fig. 5

CONTAINER HAVING BRACED PARTITIONS

BACKGROUND OF THE INVENTION

1. Field of the Invention

The invention relates to collapsible rectangular cartons formed of sheet material and having internal partitions formed from the side walls thereof, the partitions separating objects within the container.

2. The Prior Art

Multi-cell, partitioned cartons are known having the partitions separately glued to the interior walls of the carton, from one side to the other. The partitions are either formed as extensions of the end folding flap, or as tabs separated from the side walls. Such devices have required multiple gluing and manual assembly operations. Other structures are known in which the partitions are separated from the side walls except at the ends thereof, as in the ice cream carrier of U.S. Pat. No. 3,366,305. U.S. Pat. No. 3,446,414 discloses a collapsible paper board carton having inwardly-extending partitions severed from the side walls except at fold lines at opposite ends thereof, the pairs of partitions vertically and/or horizontally touching but not being attached to one another in the interior of the assembled carton. Placement of the partitions in the erected container is manually accomplished after erection of the outer walls of the carton. In other embodiments disclosed, glue tabs are provided for attaching partitions to one another. The partition structures disclosed are generally relatively complicated to engineer, to manufacture and to assemble.

SUMMARY OF THE INVENION

A multi-celled, erectable, partitioned carton is formed from a sheet-form blank, the carton comprising two pairs of opposite side walls connected together at parallel side fold lines. At least one pair of partition bands are severed from the side walls along upper and lower cut lines transversely to said side fold lines and overlying two side fold lines of said blank spaced by a third, center fold line. Each band is joined to different ones of the side walls at opposite ends of the band at band end fold lines which extend parallel to the side fold lines. The bands are attachable together at one or more attachment zones formed on faces of the bands at points equidistant from the center fold line of the carton. The carton is collapsible into a two-layer thick article and is quickly erectable with the attachments among the side walls and the partition bands automatically erecting the internal partitions. Four species of bands are disclosed for varying applications, but any number of cells may be formed by use of the principles disclosed.

THE DRAWINGS

FIG. 1 is a plan view of a sheet-form blank which is cut and scored in accordance with the invention.

FIGS. 2, 4, 7, 9 and 11 are cross-sectional views taken horizontally through upper bands of erected cartons.

FIGS. 3, 6, 8 and 10 are plan views, partially broken away, of blanks cut and scored in accordance with the invention.

FIG. 5 is a top plan view of a carton showing collapsing thereof from an erected position.

DESCRIPTION OF THE PREFERRED EMBODIMENTS

Figure 6:
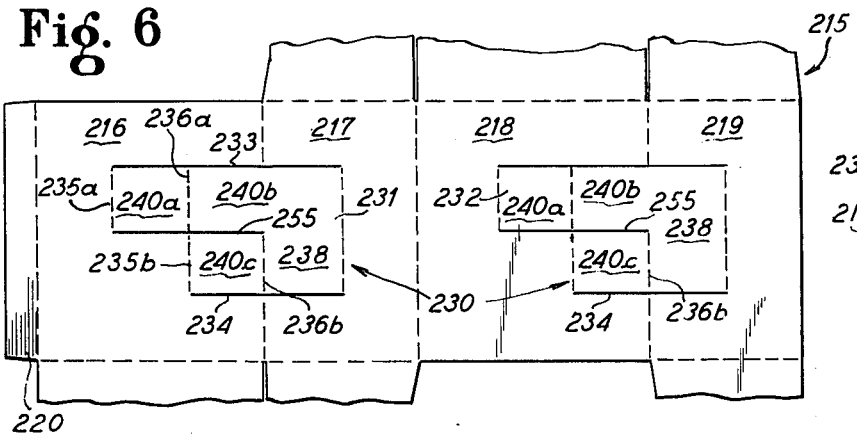

FIG. 1 shows a die-cut and -scored sheet 15 formed for assembly into a container with internally-braced partitions in accordance with the principles of the present invention. The blank 15 has formed therein four side walls 16, 17, 18 and 19. A glue flap 20 is foldably attached to one side of the side wall 16 at a fold line 21. This flap 20 is adapted to be glued to the side wall 19 to form the blank into a rectangular container. The remaining side walls are connected together at parallel side fold lines 22, 23 and 24. The side wall 19 terminates in a side edge 25. Affixed to upper and lower edges of the side walls 16–19 are top and bottom flaps 26, 27, respectively, for enclosing the container on top and bottom ends, respectively, in the erected condition. Tucking end flaps *26a*, *27a* as shown facilitate final erection.

In accordance with the invention, at least one pair of partition bands 30 is formed in the side walls 16–19. In a first embodiment, each band 31, 32 of the pair is severed from the respective side walls along an upper cut line 33 and a lower cut line 34. The bands 31, 32 remain joined to the side walls of the blank 15 at end fold lines 35. These band end fold lines 35 extend parallel to the side wall fold lines 21–24. Each of the bands 31, 32 is folded in its central portion at center band fold lines 36, 37 which, in this embodiment, are colinear with one another and with the respective side fold lines 22, 24 which are spanned by the respective partition bands 31, 32. Cut from a right half 38 of each of the bands 31, 32 by an arc joining the center fold lines 36, 37 is an attachment zone 39 formed as a glue tab cantilevered from a left half 40 of each of the bands 31, 32. As seen in FIG. 1, the bands 31 and 32 of the pair of partition bands 30 are horizontally symmetric with one another in having the same form and arrangement of cut lines 33, 34, end fold lines 35, center fold lines 36, 37 and glue tabs 39 formed with respect to the right and left halves 38, 40 of the respective bands 31, 32.

The zones 39 form a space for glue spot 41 applied equidistantly from the center fold line 23 on the bands 31, 32 of a pair of partition bands 30. Attachment together of the bands 31, 32 on their faces facilitates internal bracing together thereof. The resulting structure, as shown in FIG. 2, provides a four-celled container which is strongly braced internally by the glue joint 41 between the partitions 31, 32. In the embodiment of FIG. 2, all the cells are square; other configurations of the bands 30 including non-symmetric configuration may be employed in accordance with the invention to provide other numbers of cells or different sizes of cells in the same carton.

FIGS. 3 and 4 show a second embodiment of the invention, in which a blank 115 is formed similarly to that of FIG. 1 with side walls 116, 117, 118 and 119 and a glue flap 120 for joining the side wall 116 to the side wall 119. In the embodiment of FIG. 3, the side walls are of different lengths and so may be considered in opposite pairs, 116 and 118, 117 and 119. One pair of partition bands 130 is struck from the several side walls as previously, forming first and second bands 131, 132 having respective right and left portions 138 and 140. Each partition band 131, 132 spans a respective side wall fold line 122, 124 and is joined to adjacent side walls by end fold lines 135, as shown.

In accordance with the principles of the invention, this second embodiment has in each of the partition bands 131, 132 a central fold line 136 which is offset from a point 137 spaced midway between the end fold lines 135 of each respective band 131, 132. As shown in FIG. 4, this arrangement of the bands 131, 132 provides for cells of two different shapes. The partitions 131, 132 are joined together about the midpoints 137 thereof at a glue joint 141 formed in an attachment zone about the midpoints 137 of the respective partition bands and equidistantly from the center fold line 123 of the blank 115.

FIG. 5 shows that the carton formed from the blank 115 is arranged to be fully collapsible into a double-sheet thickness configuration. As shown by the arrows 150, each of the side fold lines 123, 124 adjoining the side wall 118 will rotate respectively about the side fold lines 122, 121, with the side wall 116 fixed in space. The central fold line 136 of the band 131 will similarly rotate about the end fold line 135 in the wall 116, so that the glue joint 141 is not disrupted. Thus, the entire structure can be folded into one double-layer thickness of material for shipping and storage until the container is to be erected for use. In fact, the blank may be folded double, the glue spot applied at 141, and the end tab 120 connected to the wall 119 without ever erecting the carton.

Figure 7:
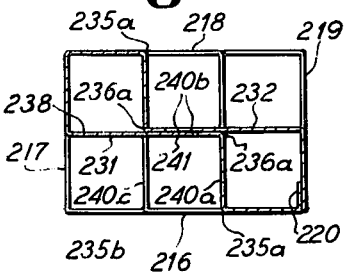

FIGS. 6 and 7 disclose a third embodiment of the present invention. A blank 215 is scored and cut to form a six-celled carton. Side walls 216, 217, 218 and 219 are formed in two pairs each of equal lengths. A pair 230 of partition bands 231, 232 are formed from the side walls by upper and lower cuts 233, 234. Each band 231, 232 is further divided horizontally on a left side 240 thereof by a third horizontal cut 255. The cut 255 extends from a first upper portion **235*a* of a left end fold line parallel to the upper and lower cut lines 233, 234. A second portion 235*b* of the left fold line intersects the cut 255 from the left-most end of the lower cut line 234. Portions 240*a* and 240*b* are formed and divided from one another above the cut line 255 by an upper central fold line 236*a*. A third portion 240*c* is divided from the right portion 238 of each of the bands 231, 232 below the cut line 255 by a lower central fold line 236*b*. The portion 240*b* is cantilevered from the right portion 238 with no fold or other structure therebetween. As shown in FIG. 7, the blank 215 of FIG. 6 is readily folded into a container having six internal cells with only one glue spot 241 between the attachment surfaces 240*a*, 240*b* of the respective partition bands 231, 232** and equidistantly from the center side fold line bracing the internal structure.

Figure 8:
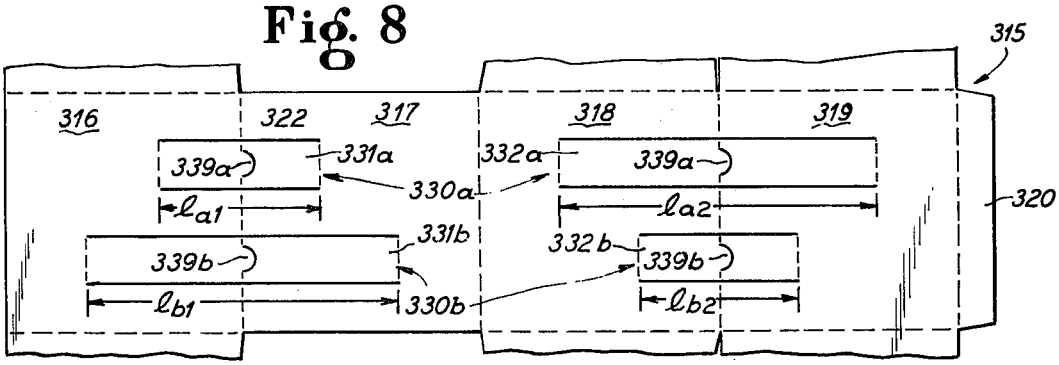
Figure 9:
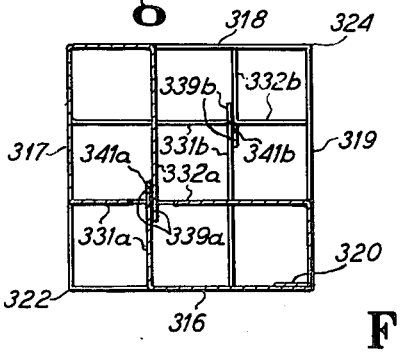
Figure 10:
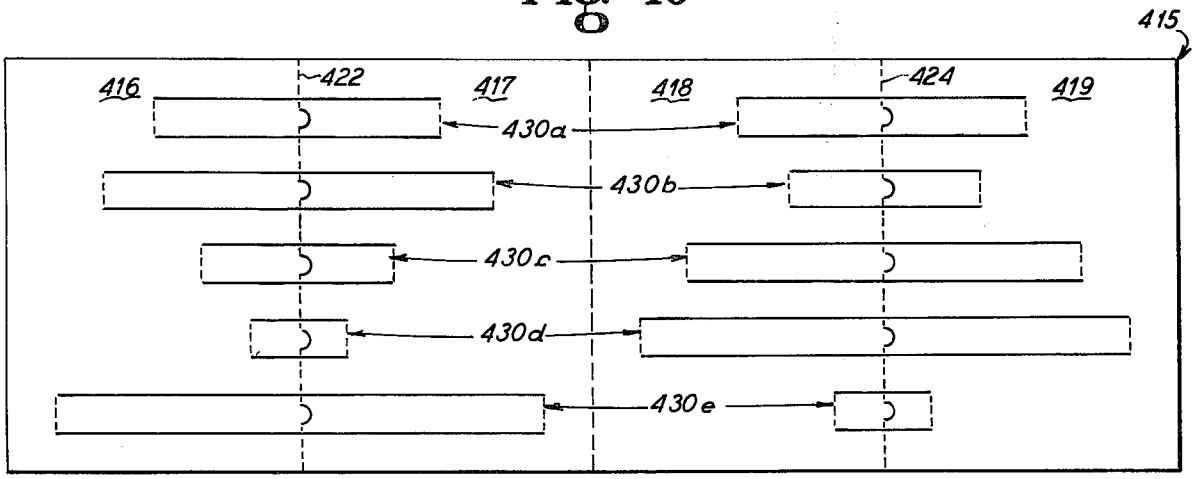

FIGS. 8 through 10 disclose a further embodiment, similar to FIG. 1 but having a plurality of pairs of partition bands in order to form nine or more partitioned cells. In FIG. 8 a sheet-form blank 315 is die-cut and -scored to form side walls 316, 317, 318 and 319 and a glue tab 320. Two pairs of bands, an upper pair **330*a* and a lower pair 330*b* are cut from the side walls spanning each of the side fold lines 322 and 324. The individual left and right bands 331*a*, 332*a* and 331*b*, 332*b* of each pair are formed like the tabs 31 and 32 of FIG. 1, with glue tabs 339*a* and 339*b* formed therein. A combined length $l$ of the bands of each pair is constant among the pairs, so that once a length $l_{a1}$ is known for the band 331*a*, the length $l_{a2}$ of the other band 332*a* is determined. Further, the combined length of the bands of the other pair of bands 330*b* is the same, and the length of each band overlying a single side fold line 322 or 324 is different from that of at least one other band also spanning that side fold line. FIG. 9 shows the blank 315 assembled and erected into a nine-cell container with glue tabs 339*a* and 339*b* connected together by respective glue spots 341*a* and 341*b*. The partitioning bands 331*b* and 332*b* underlie and are not attached to the partitioning bands 331*a*, 332*a***, but the container achieves substantial rigidity by the two internal bracing points.

Figure 11:
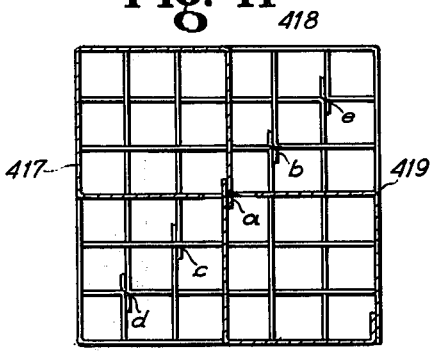

FIGS. 10 and 11 further extend the concept embodied in FIG. 8, in showing five pairs of partitioning bands **430*a–e* cut from a sheet-form blank 415. Each of the pairs of bands has a common combined length where the side walls 416, 417, 418 and 419 are of equal lengths. FIG. 11 shows an erected carton constructed from the blank 415, with the intersections of the bands of each pair of tabs 430*a–e*** labeled with corresponding letters *a–e*. As shown in FIG. 10, the lengths of the bands of each pair may be distributed in any order along the side fold lines 422, 424. As is also evident from FIG. 10, more than one pair of bands may be provided which are identical in configuration or distribution of lengths between the left and right sides on the blank 415, so that each cell may be divided at more than one location along its length from adjacent cells.

Although various minor modifications may be suggested by those versed in the art, it should be understood that all such modifications as reasonably and properly come within the scope of the disclosed contribution to the art are intended to be embodied herein.

I claim as my invention:

1. A multi-celled, erectable, partitioned carton formed from a sheet-form blank, the carton comprising:

two pairs of opposite side walls connected together at parallel side fold lines;

at least one pair of partition bands severed from said side walls along upper and lower cut lines extending generally transversely to said side fold lines and each one of each said pair of bands being joined to different ones of said side walls at each opposite end of said band at band end fold lines which extend parallel to said side fold lines, each said band thereby spanning one of said side fold lines; and each band of each pair of bands having at least one attachment zone formed on a face thereof, each of the corresponding attachment zones of the bands of each pair being spaced equidistantly from each side fold line between the ends of the bands.

2. A carton as defined in claim 1, wherein each of said bands further comprises:

a band fold line spaced between said band end fold lines and extending through upper and lower portions of said band; and each of said attachment zones being formed on a glue tab severed from one part of each said band adjoining said band fold line and extending without folding from the other half of said band, thereby to be cantilevered from said partition band when said band is folded.

3. A multi-celled, erectable, partitioned carton formed from a sheet-form blank, the carton comprising:

two pairs of opposite side walls connected together at parallel side fold lines:

at least one pair of partition bands severed from said side walls along upper and lower cut lines extending generally transversely to said side fold lines and each one of each said pair of bands being joined to different ones of said side walls at each opposite end of said band at band end fold lines which extend parallel to said side fold lines, each said band thereby spanning one of said side fold lines;

each band of each pair of bands having at least one attachment zone formed on a face thereof, each of the corresponding bands of each pair being spaced equidistantly from each side fold line between the ends of the bands;

a band fold line spaced between said band end fold lines and extending through upper and lower portions of said band;

each of said attachment zones being formed on a glue tab severed from one part of each said band adjoining said band fold line and extending without folding from the other half of said band, thereby to be cantilevered from said partition band when said band is folded; and wherein at least two pairs of said bands are spaced apart along said side fold lines, each pair of bands having the same combined lengths as others of said pairs and at least one band spanning one of the side fold lines having a length different from that of another one of said bands spanning that side fold line.

4. A carton as defined in claim 1, wherein each of said bands has a central fold line spaced to one side of a point midway between said band end fold lines, each said band being folded at said central fold line upon assembly of said carton, and said attachment zones being formed on either side of said midway point on each said band.

5. A carton as defined in claim 1, wherein each said band further comprises:

a third cut line spaced between and parallel to said upper and lower cut lines and extending only through a portion of said band from one end thereof, forming separate upper and lower band portions and a band end portion opposite said one end;

a first one of said band end fold lines joining said band end portion to one of said side walls;

a second one of said band end fold lines being divided, a first part thereof joining one of said upper and lower band portions to an adjacent one of said side walls, and a second part thereof joining the other of said upper and lower band portions to said adjacent side wall spaced between said first part of the fold line and the side fold line spanned by the band;

the longer one of the upper and lower band portions being folded on a line colinear with the second part of said second band end fold line; and the shorter one of the upper and lower band portions having a central fold line colinear with the side fold line spanned by the band.

6. A die-cut and -scored blank formable into a container with internal partitions, the partitions being braceable by attachments between faces thereof, the blank comprising:

four side walls joined sequentially to one another by parallel fold lines;

the side walls commprising first through fourth walls and having first through fifth parallel edges at said fold lines, the first and fifth edges being adapted to be connected together;

at least one pair of partition bands each severed along lines generally transverse to said fold lines, each said partition band of said pair being aligned longitudinally of said blank with the other partition band of said pair and having an attachment zone on a face thereof;

each said pair of partition bands overlying said second and fourth fold lines of said side walls, and each said partition band having at least one partition fold line extending parallel to the side fold lines and extending between adjacent ends of the severing lines, the band ends joining said partition band to the respective side walls, whereby the side walls are adapted to be folded and glued to form four sides of a container and the partitions are adapted to be joined together at said attachment zones thereof pair by pair, the erectable container formed from said blank being collapsible into a flat structure of two thicknesses of material.

7. A die-cut and -scored blank as defined in claim 6, wherein the bands of each said pair of bands are horizontally symmetric with one another on said blank.

8. In an internally-partitioned carton having a plurality of side walls and at least one pair of bands partially severed from said walls and folded inwardly thereof along vertical lines, the improvement comprising:

each pair of bands being spaced vertically from any other pairs of bands provided; and each band of each said pair of bands having an attachment zone on a face thereof, the attachment zones of each band in each pair of bands being engageable with one another.

* * * * *